United States Patent [19]

Wilson

[11] Patent Number: 4,731,927

[45] Date of Patent: Mar. 22, 1988

[54] NAIL CLIPPER AND HOLDER

[76] Inventor: Douglas B. Wilson, 14 Castle Rd., Irvington, N.Y. 10533

[21] Appl. No.: 906,351

[22] Filed: Sep. 11, 1986

[51] Int. Cl.[4] ..... A45D 29/00

[52] U.S. Cl. ..... 30/28; 30/124

[58] Field of Search ..... 30/28, 124, 134

[56] References Cited

U.S. PATENT DOCUMENTS

| | | | |
|---|---|---|---|
| 1,849,592 | 3/1932 | Schnefel | 30/28 |
| 2,887,773 | 5/1959 | Killen | 30/28 |
| 3,031,754 | 5/1962 | Pocoski | 30/28 |
| 3,188,737 | 6/1965 | Chase | 30/28 |
| 3,986,257 | 10/1976 | Kiura | 30/28 |
| 4,130,937 | 12/1978 | Kim | 30/28 |
| 4,380,120 | 4/1983 | Hannon | 30/28 |

*Primary Examiner*—Douglas D. Watts

*Attorney, Agent, or Firm*—Pennie & Edmonds

[57] ABSTRACT

A nail clipper having a pair of resilient elongated members in which the sides of the elongated members are enclosed by a flexible material that permits the elongated members to be moved together to clip the nail but simultaneously forms an enclosure which traps the nail clippings. The nail clippings may then be shaken out of the clipper through the space between the cutting edges.

6 Claims, 2 Drawing Figures

NAIL CLIPPER AND HOLDER

BACKGROUND AND SUMMARY OF THE INVENTION

This relates to an improved nail clipper and the like.

A typical nail clipper comprises first and second elongated members which are joined at one end so that cutting edges at the opposite end are spaced apart approximately a quarter of an inch in cutting relationship. A small lever typically is mounted near the cutting end and extending rearwardly so that the free end of the lever and the joined ends of the elongated members may be squeezed together in such a way as to forec the cutting edges together.

While this device is quite effective as a nail clipper, the problem with it—as known by anyone who has used it and by anyone who has cleaned up there after—is that nail clippings tend to fly all over the place.

The present invention is related to an improvement in the nail clipper which prevents the nail clippings from flying around. In accordance with a preferred embodiment of the invention, the sides of the elongated members are enclosed by a flexible material that permits the elongated members to be moved together to clip the nail but simultaneously forms an enclosure which traps the nail clippings. The nail clippings may then be shaken out of the clipper through the space between the cutting edges.

BRIEF DESCRIPTION OF DRAWING

These and other objects, features and advantages of the invention will be more readily apparent from the following detailed description of a preferred embodiment of the invention in which.

DETAILED DESCRIPTION OF THE PREFERRED EMBODIMENT

Figure 1:
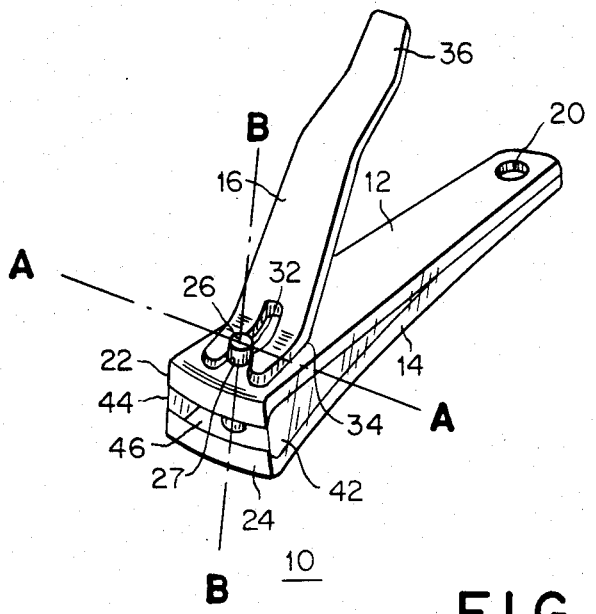
FIG. 1 is a perspective view of a preferred embodiment of the invention.

As shown in FIG. 1, a nail clipper 10 comprises first and second resilient elongated members 12, 14 and a lever 16. Members 12, 14 are joined together at one end 20 to form a V-shaped structure whose sides may be urged together against the resiliency of members 12, 14. Cutting edges 22, 24, respectively, are located at the other end of each of the elongated members 12, 14. Illustratively, each cutting edge is integral with an elongated member, but other arrangements can be used if desired.

Lever arm 16 is secured to the nail clipper by a post 26 which is mounted on elongated arm 14 and extends through a hole 27 in elongated arm 12. Lever arm 16 is mounted in a notch 32 in post 26 so that the lever can be related about an axis A—A perpendicular to axis B—B of post 26. As indicated, lever arm 16 is L shaped so as to define a corner 34 which bears against the upper surface of elongated member 12. When free end 36 of lever arm 16 and joined end 20 are squeezed together so as to move free end 36 toward end 20 of elongated members 12, 14, lever 16 pivots in notch 32 and corner 34 drives elongated member 12 toward elongated member 14. As a result, cutting edges 32, 34 are brought into contact and sufficient mechanical advantage is generated so as to cut a nail that may be inserted between the cutting edges. Upon releasing pressure on free end 36 and joined end 20, the resiliency of members 12, 14 separates cutting edges 32, 34.

As will be familiar to those who have used such nail clippers, post 26 is rotatably mounted in member 14 and hole 27 so that the position of lever arm 16 can be rotated 180 degrees about the axis of post 26 and the lever arm then folded down over the top of post 26 into contact with the upper surface of elongated member 12.

The foregoing construction and operation is part of the prior art.

As will be recognized by those who have used such a device, the forces generated when cutting a nail are sufficient to launch a nail clipping a substantial distance. In accordance with the invention, the sides of the elongated members are enclosed by a flexible material 42, 44 such as a plastic or fabric tape or membrane which in conjunction with elongated members 12, 14 defines an enclosure 46 which traps the nail clipping. The clippings may then be shaken out through the opening between cutting edges 22, 24.

Figure 2:
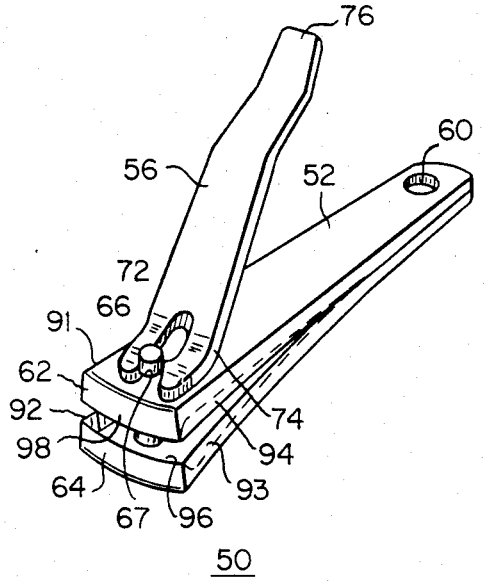
FIG. 2 is a perspective view of an alternative embodiment of the invention.

Alternatively, as shown in FIG. 2 wherein like elements are identified by the same number incremented by 40, flanges or panels 91–94 may be mounted on each side of each of the elongated members so as to define two substantially identical trough-like structures 96, 98 with sides that taper in height from approximately the height of the cutting edge in the vicinity of the cutting edge to nothing near joined end 60. As a result of this structure, the two trough-like structures form an enclosure which prevents the loss of a nail clipping when the cutting edges 22, 24 are in contact but provide an opening when the elongated members spring apart.

As will be apparent to those skilled in the art, numerous modifications may be made within the spirit and scope of the above described invention.

What is claimed is:

1. A nail clipper comprising:

first and second elongated members, each having first and second ends and first and second sides therebetween, said first and second elongated members being joined together at said first end such that said second ends oppose one another in spaced apart relationship, at least one of the second ends being movable toward the other, first and second flexible members extending between the first sides and between the second sides, respectively, of the first and second elongated members, said flexible members being attached to said elongated members so that an enclosure is defined by only said first and second elongated members and said first and second flexible members, and cutting means at said second end of at least one of said first and second elongated members for cutting a nail when the second ends of the first and second elongated members are brought into contact with the nail.

2. The nail clipper of claim 1 wherein said first and second elongated members are resilient.

3. The nail clipper of claim 2 further comprising lever means bearing on one of said first and second elongated members for forcing said resilient elongated members together.

4. The nail clipper of claim 1 wherein the flexible members are made of tape.

5. The nail clipper of claim 1 wherein the flexible members are made of a plastic or fabric tape.

6. The nail clipper of claim 1 wherein the flexible members are made of a plastic or fabric membrane.

* * * * *